US012662345B2

(12) United States Patent
Bertoli Barsotti

(10) Patent No.: US 12,662,345 B2
(45) Date of Patent: Jun. 23, 2026

(54) REWINDER MACHINE AND RELATIVE CORE INTRODUCTION CRADLE ADAPTABLE TO CORES OF DIFFERENT DIAMETERS

(71) Applicant: Giotto Technologies S.r.l., Borgo a Mozzano (IT)

(72) Inventor: Giovanni Bertoli Barsotti, Buggiano (IT)

( * ) Notice: Subject to any disclaimer, the term of this patent is extended or adjusted under 35 U.S.C. 154(b) by 185 days.

(21) Appl. No.: 18/576,476

(22) PCT Filed: Jul. 22, 2022

(86) PCT No.: PCT/IB2022/056786
§ 371 (c)(1),
(2) Date: Jan. 4, 2024

(87) PCT Pub. No.: WO2023/002445
PCT Pub. Date: Jan. 26, 2023

(65) Prior Publication Data

US 2024/0308805 A1 Sep. 19, 2024

(30) Foreign Application Priority Data

Jul. 23, 2021 (IT) ..... 102021000019676

(51) Int. Cl.
*B65H 19/22* (2006.01)

(52) U.S. Cl.
CPC ... *B65H 19/2269* (2013.01); *B65H 2408/235* (2013.01)

(58) Field of Classification Search
CPC ..... B65H 19/22; B65H 19/2269; B65H 2408/235; B65H 2511/14
See application file for complete search history.

(56) References Cited

U.S. PATENT DOCUMENTS 5,769,352 A 6/1998 Biagiotti
7,802,748 B2 * 9/2010 De Matteis ..... B65H 19/2269 242/532.3
9,365,379 B2 * 6/2016 Mazzaccherini ..... B65H 19/22

FOREIGN PATENT DOCUMENTS

EP 3056458 8/2016

* cited by examiner

*Primary Examiner* — Sang K Kim
(74) *Attorney, Agent, or Firm* — Themis Law

(57) ABSTRACT

A cradle system for a rewinder machine shapes a rolling surface for a core and includes at least two portions arranged to define the rolling surface. The at least two portions are each movable in a predetermined position so as to vary the profile of the rolling surface and/or the length of the rolling surface as a function of their assumed positions.

9 Claims, 8 Drawing Sheets

REWINDER MACHINE AND RELATIVE CORE INTRODUCTION CRADLE ADAPTABLE TO CORES OF DIFFERENT DIAMETERS

SCOPE OF THE INVENTION

The present invention relates to the technical sector relating to rewinder machines for the production of rolls or logs made of material, for example paper rolls of the "Tissue" sector (for example kitchen rolls and large-sized rolls, toilet paper, etc.).

In particular, the invention refers, in a rewinder machine, to an innovative cradle for introducing the core into the winding area of the rewinder machine, and with such a cradle capable of adapting to different diameters of the core.

A BRIEF OUTLINE OF THE PRIOR ART

Rewinder machines have been around for a very long time.

They are used to produce rolls or logs that are then placed on the market, e.g. paper rolls such as those to be used in the kitchens, toilets (e.g. toilet paper), etc.

In addition to paper, different materials such as NWF (i.e. non-woven fabric) or similar can be used.

Generally, the production line involves unwinding of one or more material strips, for example paper, from one or more parent coils.

The strip (or strips, depending on whether single-ply or multi-ply product is made) passes along the various stations of the machine until it reaches the heart of the machine which is represented by the winding section.

Obviously, upstream of the winding area, other operations can generally be carried out on the strip being processed, depending on the case, such as embossing, knurling, transverse incisions for the formation of tearing lines that will define the individual panels of each roll, etc.

A winding section is delimited by an upper winding roller (also referred to as the first roller), a lower winding roller (also referred to as the second roller) and a press which define the winding space. The first and the second roller are rotatable around their longitudinal axis and fixed to the machine frame.

The press comprises a roller (also known as the third roller) which is also rotatable around its longitudinal axis and which is movable in such a way that it can move closer to/away from the two aforesaid rollers. Its function is to press on the roller being formed.

More in detail, the press therefore provides a movable arm, for example rotatable around a fulcrum, to which said additional roller is rotatably applied, generally applied to said arm at the end opposite to the hinging one.

Overall, therefore, the winding area is delimited by said upper and lower winding roller and by the roller of the press which is generally placed downstream with respect to the two winding rollers.

In this description, the term "upstream" or "downstream" is to be understood with reference to the direction in which the strip advances in the processing path.

In this sense, therefore, considering the direction of advancement of the strip, the above-mentioned "downstream" arrangement of the press implies that it, by following the path of the strip, is arranged after the aforementioned rollers.

The entry to said winding area is achieved with an entry cradle that precisely represents an entry path for a core around which the paper is wound.

The core is therefore a cylindrical tubular whose length corresponds to the final roll produced (generally called "log"). The core can be in various materials but, generally, it is made of cardboard. The length of the core corresponds more or less to the paper opening span that is unrolled from the parent coil and therefore the length of the final log corresponds to the paper opening span.

The final log is then cut through a special cutting machine in order to obtain from each log a certain number of rolls ready to be packaged and placed on the market.

The winding area, as mentioned, represents the heart of the rewinder machine as it is precisely in this part that the single core on which the winding of the strip being processed begins is sent.

Generally, therefore, access to the winding area takes place through the entry cradle which generates a path along which the incoming core rolls until it reaches the winding space.

The cradle is generally in the form of guides (one or more than one) arranged below the upper roller and defining the path of the core from the introduction point to the Nip point.

The Nip point is defined as the point where the core is in contact with the two winding rollers (the first and the second roller) and the axis of the core is on the plane passing through the two axes of the rollers. The nip represents more or less the minimum space between the two said rollers and can be considered as the entry to the winding area.

The winding area is therefore generally delimited, past the nip, by the lower winding roller, by the upper winding roller and by the so-called "press" located downstream of the two aforesaid winding rollers.

The lower winding roller and the upper winding roller are two rollers rotatably fixed to the machine frame and which rotate around their longitudinal axis in such a way as to bring into rotation the core that is in contact with them.

More particularly, the upper winding roller is rotatably fixed to the machine frame. The lower roller is rotatably fixed to a frame of the machine that also allows to vary the distance between upper and lower roller in order to adjust the diameter of the core.

The two rollers rotate in such a way as to bring into rotation the core that is in contact with them and then carrying out the winding to form the roll.

The rotation of the core and consequently of the roll being formed therefore occurs by contact with the two winding rollers.

A technical problem related to today's rewinder machines concerns the fact that it is often necessary to have to work with different core diameters because several formats have to be processed with the same machine.

This also affects the cradle since, as a function of the diameter of the core, a specific cradle of correct length and correct radius of curvature is generally required.

The simple solution that provides for the rigid translation of the cradle in order to create the right rolling space of the incoming core is not enough because, de facto, the radius of curvature of the cradle remains unchanged as well as its length remains unchanged.

Depending on the core diameter, instead, it would be necessary to have cradles with a specific radius of curvature and length.

Publication U.S. Pat. No. 5,769,352 is further known.

SUMMARY OF THE INVENTION

The need is therefore felt for a technical solution that can mitigate the aforesaid problems.

In particular, s an object of the present invention to provide an introduction cradle system that solves at least in part the aforesaid technical drawbacks.

More particularly, it is an object of the present invention to provide a cradle system for introducing a core, for rewinder machine, which is able to adapt perfectly to cores of different diameter, hence by modifying the profile of the rolling surface that it constitutes and/or even its overall length of said rolling surface.

These and other purposes are therefore achieved with the present cradle system for a rewinder machine, in accordance with claim 1.

Said cradle system generates a rolling surface for a core and is characterized in that it comprises at least two portions (32, 33, 41) arranged between them in such a way as to define said rolling surface.

In accordance with the invention, such at least two, preferably three, portions are connected between them and movable independently of each other.

Advantageously, thanks to this solution, it is possible to vary the profile of said rolling surface and/or the length of said rolling surface as a function of the final positions that are assumed by each one of said portions.

In this way, as a function of the diameter of the core, it is possible to adjust the correct position of said portions, thus obtaining a rolling track for the core (i.e. the surface of the cradle) which is not only at the correct distance from the upper roller but also has the correct length and/or profile precisely as a function of the diameter of the core.

More particularly, therefore, this cradle system comprises at least three portions (or parts as one may say) and of which:

- An entry portion (32) and an intermediate portion (33) connected at a point (34) to said entry portion (32) so as to be able to at least rotate around said connection point (34), said entry portion (32) being fixed to a movable, preferably translatable, support (31) which can move (preferably translate) in at least two or a plurality of different positions;
- An exit portion (41) movably mounted, preferably rotatably mounted with respect to a rotation axis (A), so as to be able to assume at least two or a plurality of different angular positions;
- Means are also included that generate a force, preferably an elastic force, which keeps the intermediate portion in contact with the exit portion.

In accordance with this solution, overall, said entry, intermediate and exit portions constitute said rolling surface for the core whose length and/or profile vary as a function of the position assumed by the entry portion and the position assumed by the exit portion.

In fact, by realizing now a cradle actually in three movable parts, it is possible to modify the profile thereof (thus profile of the rolling surface for the core) and/or length by selecting the appropriate positions, e.g. angular and translational.

For example, by rotating the exit portion to a certain angular position and by translating the entry portion to a certain position, a certain distance will be generated between said two portions which results in the overall length of the rolling track and which varies if these positions are varied.

More particularly, the angular position of said exit portion can be changed by rotating it to a certain position.

Further, the position can be changed through a translation, for example, by making it integral with the lower roller which can be translated by moving it closer and/or away from the upper roller as a function the diameter of the core.

The intermediate portion is further forced to rotate with respect to the entry portion about its hinging point.

The means that cause the rotation thereof are such as to maintain the part opposite the hinging, at least for a part thereof or an end thereof, always in contact with the exit portion in such a way as to generate a continuity connection between said two entry and exit portions and to generate the rolling track of the core.

Depending on the relative positions assumed by the entry portion and the exit portion, the intermediate portion will clearly assume a certain angular position which overall will contribute to modifying the profile of the rolling track of the core at least in the area that corresponds precisely to said intermediate portion.

Furthermore, depending on the relative positions between the entry and exit portion, their relative distance varies and they are joined together by the intermediate portion whose length is such as to always overlap, at least in part, the exit portion.

In this way, in any position, there is a bridge for the passage between the entry and exit portion with a consequent variation in the overall length of the cradle.

The intermediate portion may be shaped in the form of fingers that are inserted into special seats of the exit portion in such a way as to form a complementary coupling that generates the rolling track part for the core and with such fingers being able to slide in such seats during the arrangement of the relative positions between the entry and exit portion.

This varies the length of the cradle but also the overall profile of the cradle.

Advantageously, said entry portion (32) is translatable.

Advantageously, also said exit portion is further mounted in a translatable manner, preferably integrally, for example, to the lower winding roller.

Advantageously, said exit portion is configured to be rotatably mountable around the longitudinal axis of the lower winding roller (20) of a rewinder machine and mounted so as to be able to translate integrally with said lower winding roller.

Advantageously, the entry portion can be mounted translatable so as to be able to move away from or closer to the upper winding roller (10) of a rewinder machine.

Advantageously, said means generating a force that keeps the intermediate portion in contact with the exit portion are in the form of elastic means, for example a torsional spring applied for example at the hinging.

A rewinder machine is also described herein comprising:

- An upper winding roller;
- A lower winding roller;
- A cradle system which together with the upper winding roller forms a channel for inserting a core in a winding area of said rewinder machine, said channel being delimited above by said upper winding roller and below by the rolling surface shaped by the cradle system;
- Said cradle system comprising at least two portions (32, 33, 41), preferably three portions, arranged so as to define said rolling surface and wherein each one of said at least two portions is movable in a predetermined position so as to vary the profile of said rolling surface and/or the length of said rolling surface as a function of their assumed positions.

Advantageously, said cradle system comprises three portions and of which:

An entry portion (32) and an intermediate portion (33) connected at a point (34) to said entry portion (32) so as to be able to at least rotate around said connection point (34), said entry portion (32) being fixed to a movable support (31) in at least two or a plurality of different positions;

An exit portion (41) mounted at least rotatably with respect to a rotation axis (A), so as to be able to assume at least two or a plurality of different angular positions;

And wherein means are included that generate a force that keeps the intermediate portion in contact with the exit portion in such a way that overall said entry, intermediate and exit portions constitute said rolling surface for the core whose length and/or profile are a function of the translation position assumed by the entry portion and the angular position assumed by the exit portion;

Advantageously, said exit portion can be rotatably mounted around the longitudinal axis of the lower winding roller (20) and is further mounted so as to be able to translate integrally with said lower winding roller.

Finally, an object of the invention is also a method for making a winding cradle for a rewinder machine, the method comprising making the cradle by making at least three distinct portions and of which:

An entry portion (32) and an intermediate portion (33) connected at a point (34) to said entry portion (32) so as to be able to at least rotate around said connection point (34), said entry portion (32) being fixed to a translatable support (31) in at least two or a plurality of different positions;

An exit portion (41) mounted at least rotatably with respect to the lower winding roller of said rewinder machine so as to be able to assume at least two or a plurality of different angular positions;

And wherein means are included, preferably elastic means, which generate a force that keeps the intermediate portion in contact with the exit portion in such a way that overall said entry, intermediate and exit portions constitute said rolling surface for the core whose length and/or profile are a function of the translation position assumed by the entry portion and the angular position assumed by the exit portion.

BRIEF DESCRIPTION OF THE DRAWINGS

Further features and advantages of the present cradle system and relative rewinder machine, according to the invention, will become clearer with the following description of some of its embodiments, made by way of non-limiting example, with reference to the accompanying drawings, in which.

DESCRIPTION OF SOME PREFERRED EMBODIMENTS

Figure 5:
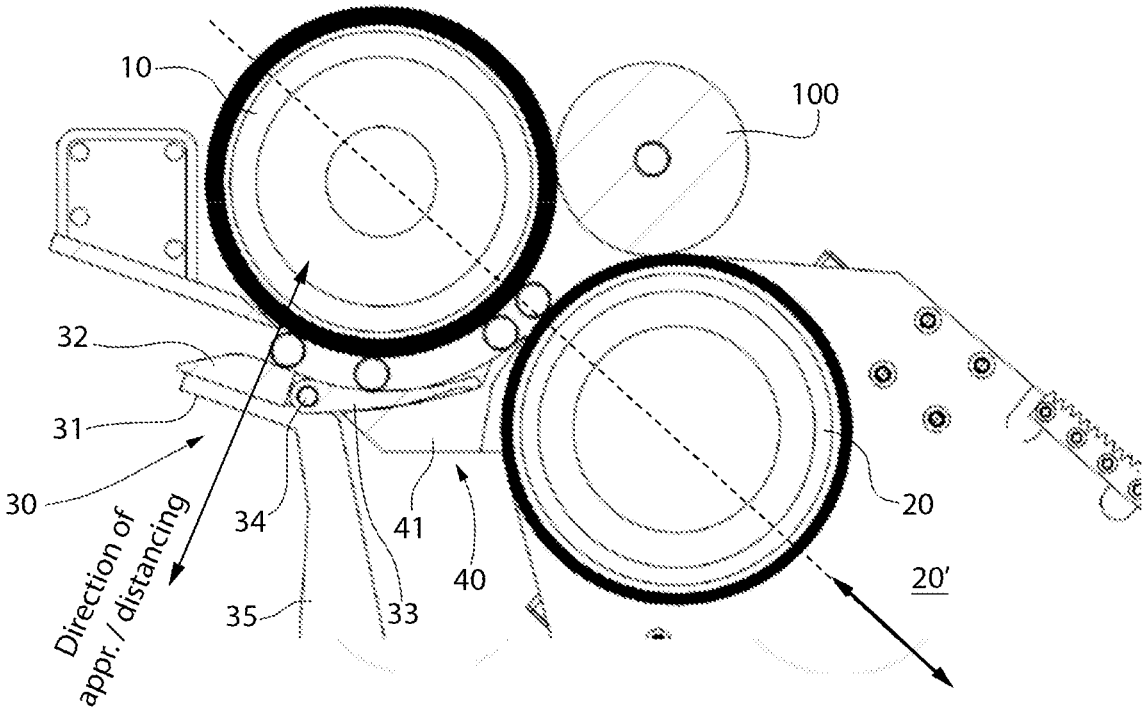
FIGS. 5 to 8 are views in front section in order to show the operation through the introduction of cores of different diameter.

In accordance with the invention, FIG. 5 schematises the cradle system object of the invention.

The figure in question therefore shows the upper winding roller 10 and the lower winding roller 20. The figure also shows, for clarity's sake and by way of example, the roll 100 being formed, i.e. in the winding phase.

For the sake of simplicity, the figure does not show the press as it is not a specific object of the present invention.

As already well known in the state of the art, the lower roller 20 is rotatably mounted on a support 20' and this support is translatable, so as to move the lower roller away from the upper roller and vary the distance between them. In this way, like for example shown in FIG. 6 below, cores of different diameter can be introduced as the insertion channel actually increases in width.

FIG. 5 shows for clarity's sake the axis joining the two centres of the two said rollers and the double arrow direction therefore shows the possible translation that the support frame 20' can make with respect to the upper roller 10 in order precisely to change its distance.

The support frame 20' can therefore be positioned at different distances from the roller 10.

Continuing in the structural description of the invention, FIG. 5 shows the cradle system object of the invention.

In particular, the cradle system is formed by two mutually cooperating parts (30, 40) that together form the cradle system object of the invention.

In particular, a first part 30 of the cradle system and a second part 40 of the cradle system are included.

Said first part 30 of the cradle system is, in turn, formed by the following portions.

In particular, it comprises the following elements:

A movable, preferably translatable, support plane 31;

A first cradle portion 32 (or entry portion) fixed integrally to said support plane 31 and an intermediate cradle portion 33 hinged (thus "pivoted" or rotatable as one may say) to said first cradle portion 32.

The second part 40 instead comprises a second cradle portion 41 (or exit portion) mounted rotatably with respect to the lower roller.

So, the second part 40 can translate integrally with the lower roller and can also rotate with respect thereto.

Said second cradle portion 41 is further cooperating with the intermediate portion 33 in such a way that a continuity of path is created and with this path therefore being defined precisely by the first portion 32, by the intermediate portion 33 and by the second portion 41.

All three of these portions have an upper surface that defines the rolling surface for the core and, therefore, this upper surface delimits the entry channel below. Above, the entry channel is delimited by the upper roller (see, for example, FIG. 5).

Both the intermediate cradle portion 33 and the second portion 41 shape the upper surface with a certain radius of curvature.

As better clarified below, the adjustment of the curvature profile of the cradle, and also the length thereof, is modified as a function of the diameter of the core being inserted thanks precisely to the rotation that the intermediate portion 33 can make with respect to the first portion 31 in combination with the rotation of the second portion 41 with respect to the lower roller to which it is hinged.

In fact, FIG. 5 shows the rotation pin 34 that rotatably connects the intermediate portion 33 to the first portion 32.

With reference to FIGS. 1 to 4, the components more detail, introduced above are described in structurally.

Figure 3:
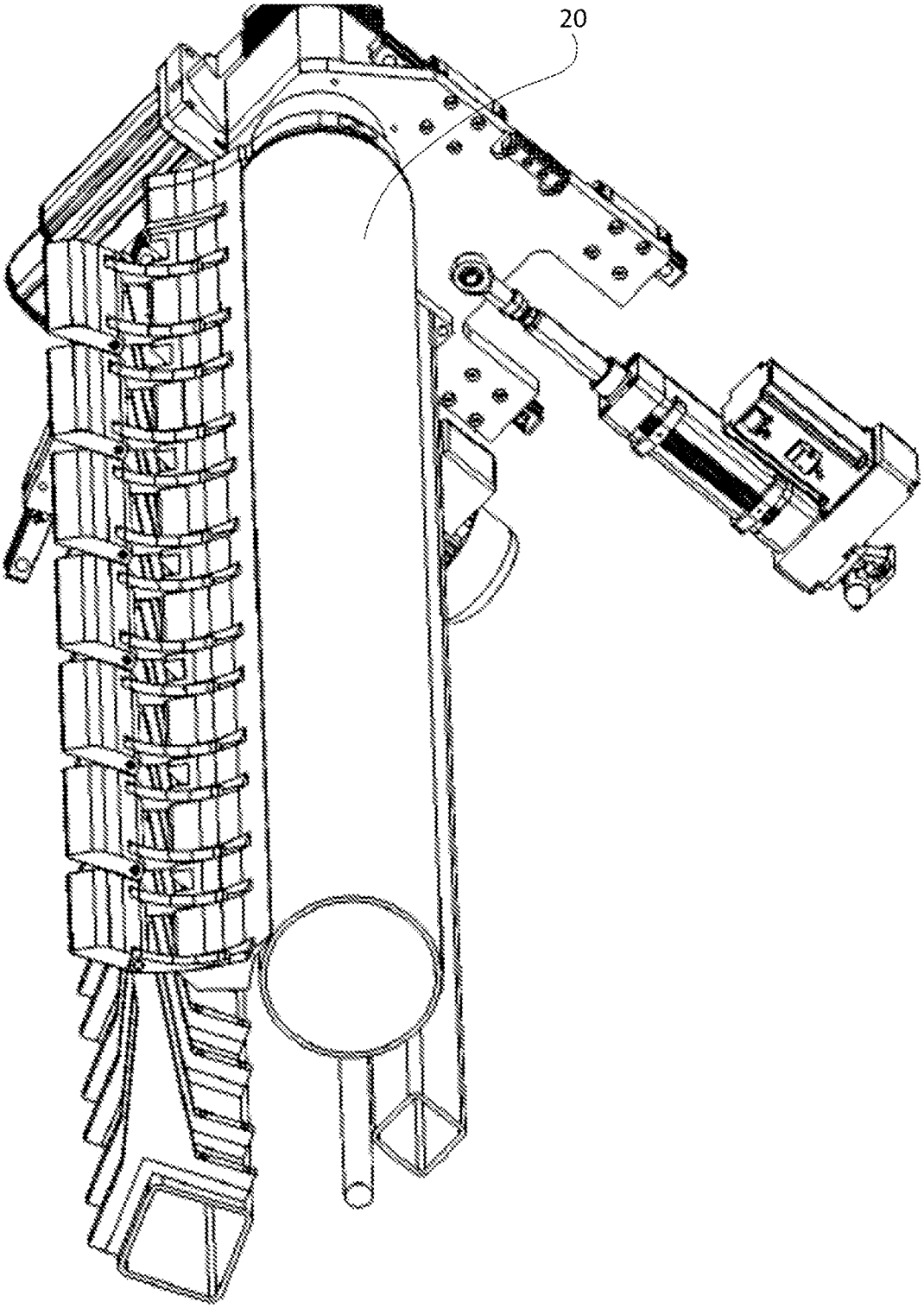
FIGS. 3 and 4 are further axonometric overviews always in accordance with the cradle system object of the invention.
Figure 4:
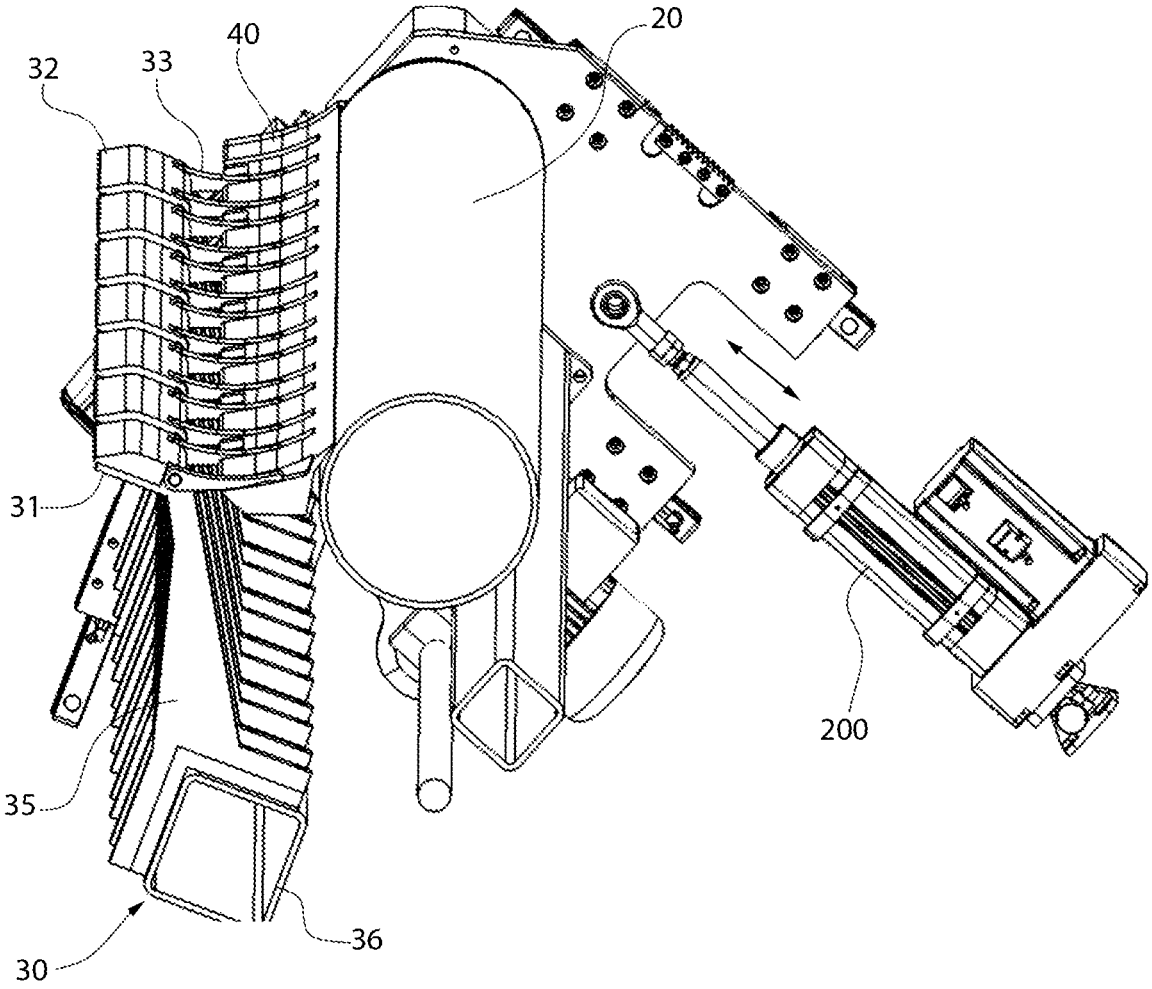

With reference to the first cradle part 30, the axonometric view of FIG. 3 and FIG. 4 best show the frame thereof.

The support plane 31 is actually a rest plane consisting of the end part of an arm 35 fixed to a support tubular 36.

The support tubular 36 can translate as it is connected to an actuator.

In particular, it is mounted sliding with respect to a sliding guide with respect to which it slides in such a manner that it can move according to a direction of distancing/approach with respect to the upper roller, as also indicated by the double arrow direction of FIG. 5.

More particularly, the distancing/approach direction is preferably perpendicular to the upper plane of the portion 32 (thus actually perpendicular to the plane 31). Alternatively, this translation can take place along a direction that is radial to the upper roller passing through the introduction point.

Figure 6:
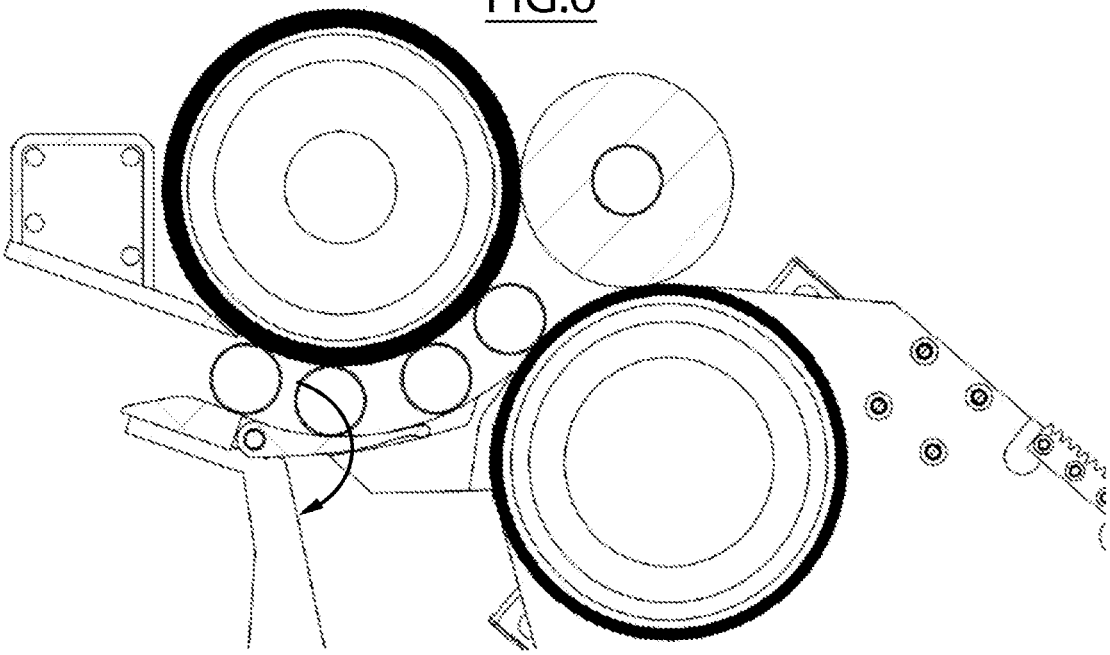
Figure 7:
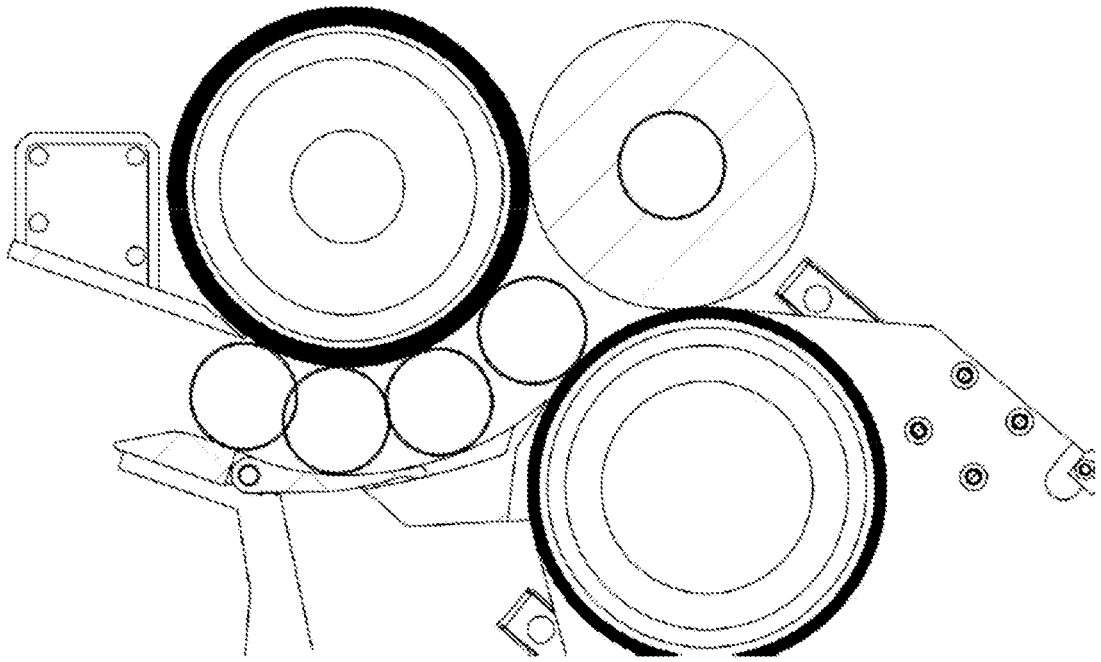
Figure 8:
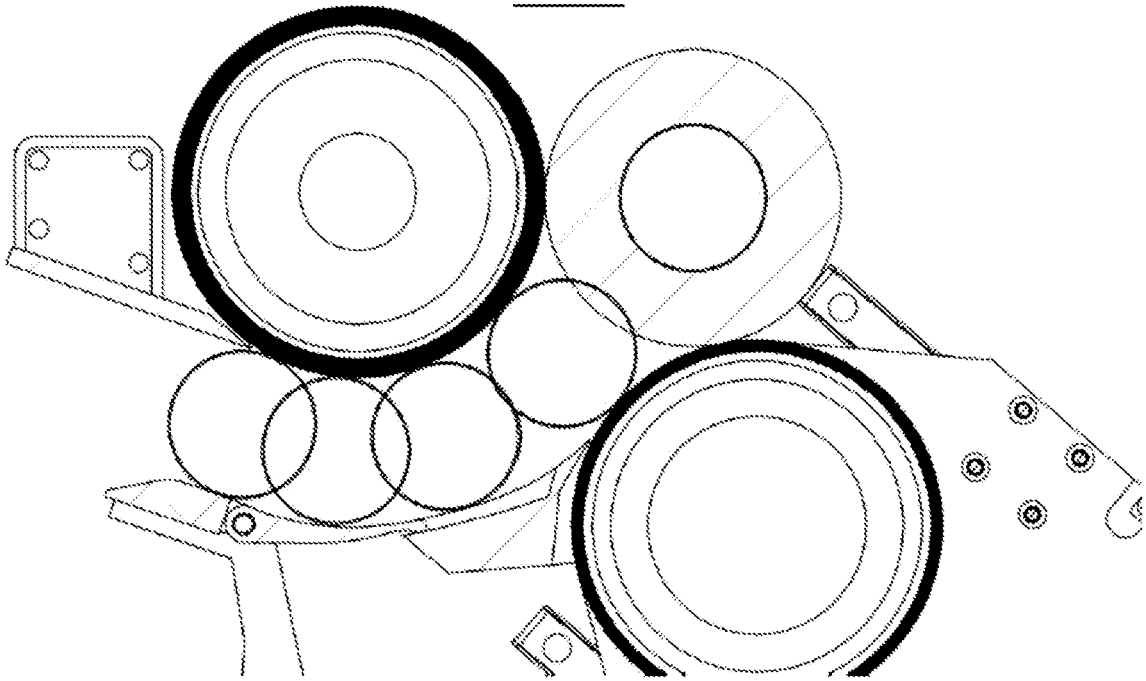

In all cases, in this way, it is possible to vary the width of the entry duct of the core as is in fact evident from the sequence of FIGS. 5 and 6 which represent respectively the case of the passage of cores with two different diameters (the diameter of the cores of FIG. 5 is smaller than the diameter of the cores of FIG. 6).

It is therefore clear that, with reference to FIG. 5 for example, lowering the arm 35 leads the first cradle portion 32 and the intermediate portion 33 to move away from the upper roller, thus increasing the width of the core introduction channel.

Returning to FIG. 4 or FIG. 3, it is evident that the cradle must have a width adapted to accommodate the entire longitudinal length of the core which is in the form of a cylinder. For this reason, there are a plurality of arms 35 fixed to the support 36 and placed one next to the other. Generally, two consecutive arms 35 support the first part 32 and the intermediate part 33 of the cradle.

Returning, for example, to FIG. 5, the hinging 34 is highlighted which rotatably connects the intermediate portion 33 to the first portion 32 (defined in this text also with the equivalent term of cradle entry portion).

The hinging may include in its inside a torsion spring which tends to rotate the intermediate portion 33 clockwise (with reference to FIG. 5), ensuring that this intermediate portion is always pressed and therefore in contact against the exit portion 41.

FIG. 6 shows in fact the direction of the arrow applied to the intermediate part 33, which actually represents the action of the elastic force on this intermediate part, thus causing a twisting force in the clockwise direction.

Such an elastic force, as mentioned, is preferably obtained by applying a torsional spring at the hinging 34 but, of course, other equivalent solutions would be possible.

Figure 1:
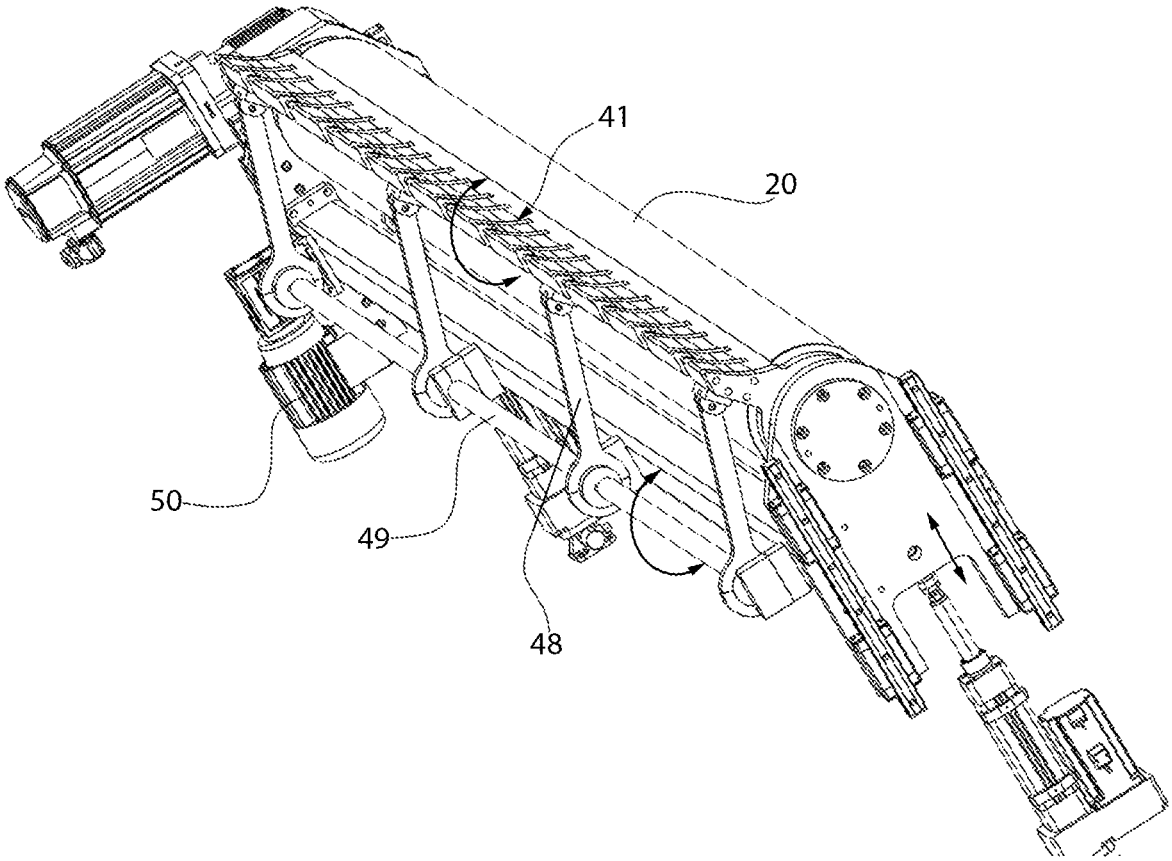
FIG. 1 is an axonometric overview of the cradle system in accordance with the present invention.
Figure 1A:
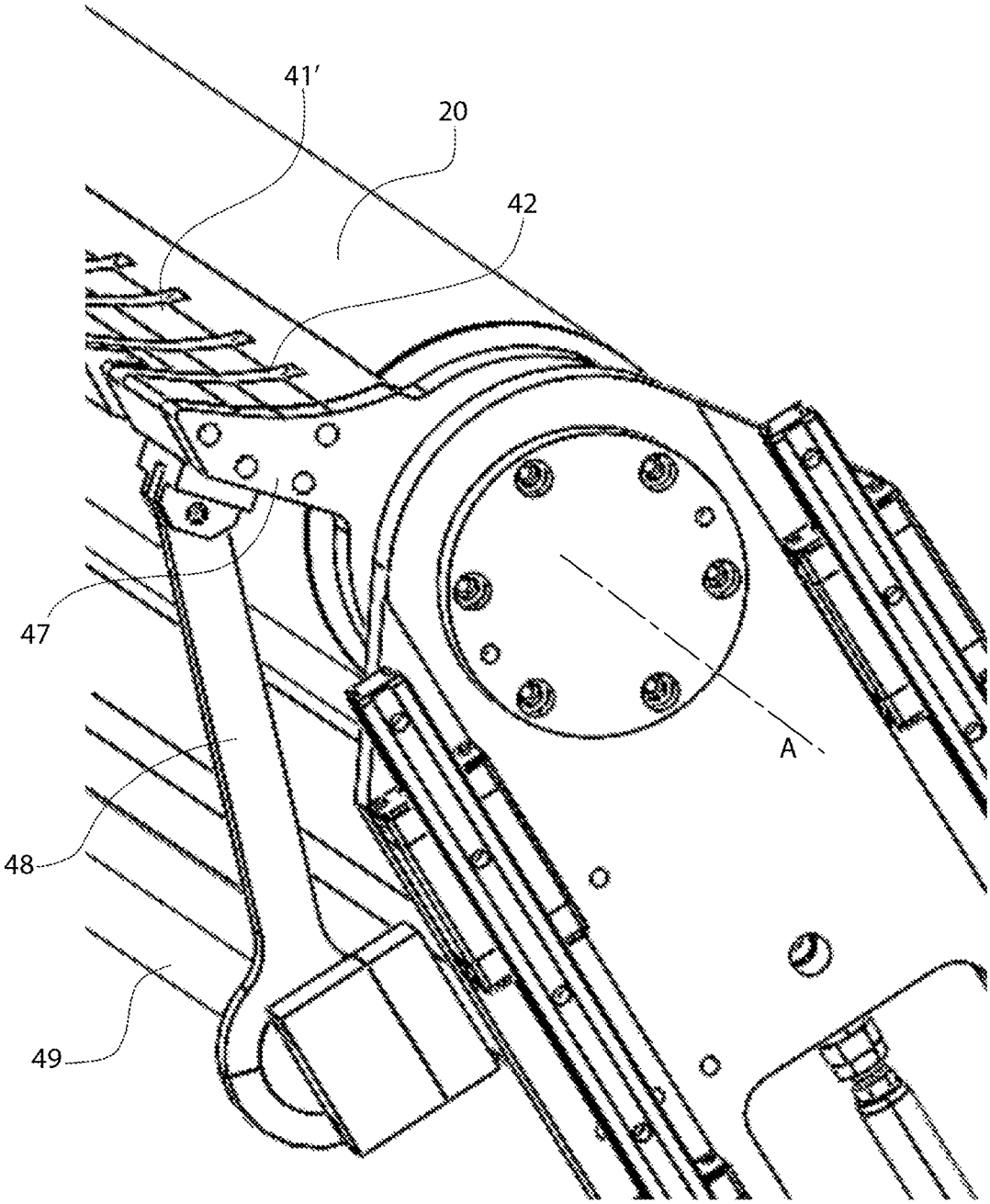
FIG. 1A is an enlarged detail of FIG. 1.

Turning then to the exit portion 41, this is well highlighted in FIGS. 1 and 1A.

FIG. 1 shows the lower roller 20 to which the frame forming the exit portion 41 is rotatably fixed.

This frame is in the form of a single bar machined in such a way as to precisely shape the curved exit path 41' shown in the enlarged view of FIG. 1A.

Said bar, on its surface 41' which forms precisely as mentioned the exit rolling surface of the core, has a plurality of notches 42 positioned and of such a size as to be able to receive, each one, a part of the intermediate portion 33 placed in front.

Figure 2:
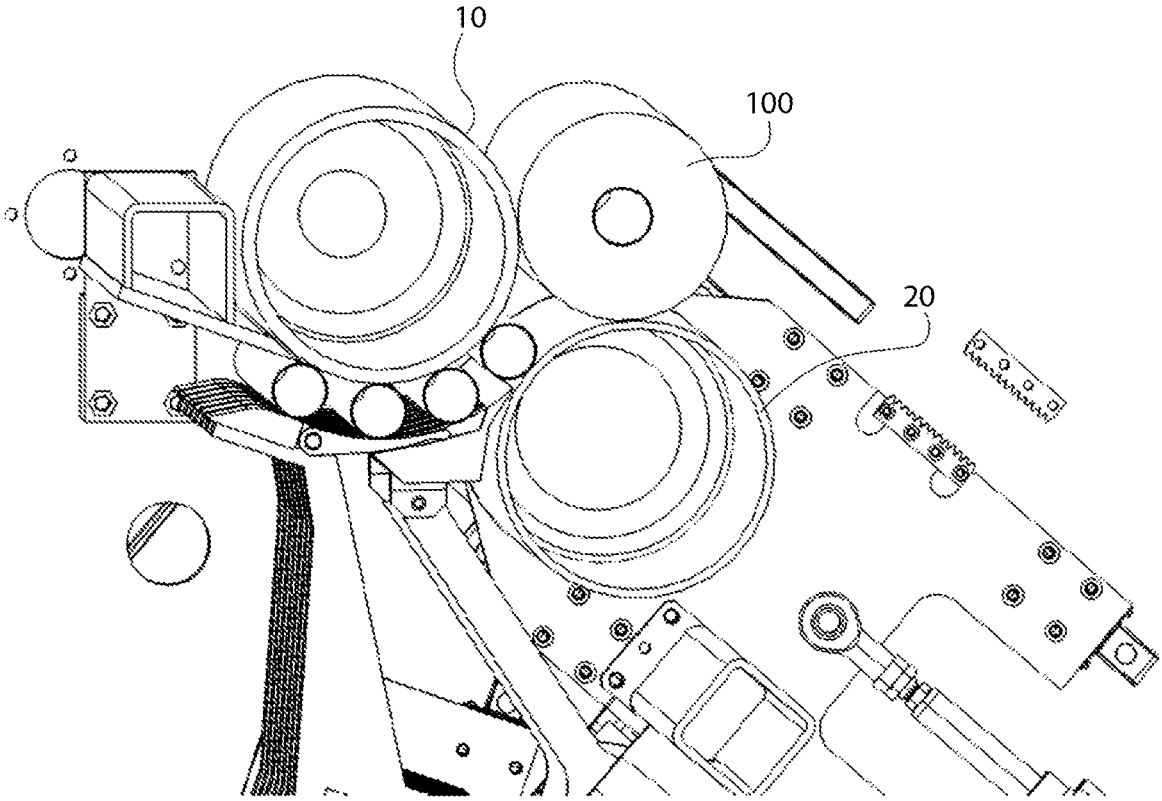
FIG. 2 is a further axonometric overview.
Figure 2A:
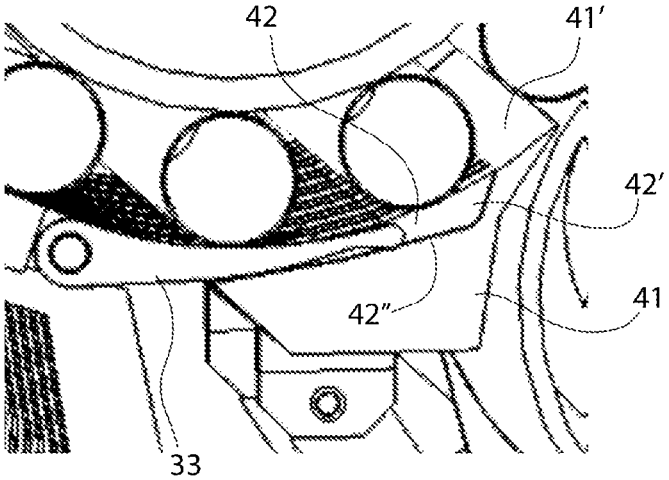
FIG. 2A is a detail view of FIG. 2.

The sectional conformation of said bar 41, and therefore of each notch that receives the intermediate portion, is well evident in the enlarged view of FIG. 2A, in FIG. 4 and in FIGS. 5 to 8.

The profile 41' has a certain radius of curvature as well as the intermediate portion 33 which also has an outer surface with a certain radius of curvature on which the core rolls (see FIG. 2A).

This intermediate portion is shaped like a hand with a plurality of fingers and with the fingers (hinged) having a certain curved outer profile on which the core rolls in use. The fingers are therefore hinged, each one, to the entry portion of the cradle (usually with a flat profile or even with a certain radius of curvature).

As can be clearly seen from FIG. 2A, the exit portion has a plurality of notches that house, each one, a finger. The notch thus forms a recess 42 delimited by a side wall 42' and a bottom base 42" which is the one on which the relative finger of the intermediate portion 33 is pushed and elastically held abutting. The curved outer surface 41' of the exit portion has a certain radius of curvature while the bottom wall 42" of the notch is substantially straight or in any case with a lower radius of curvature (generally with a dedicated radius of curvature). This implies that, by moving starting from the wall 42' along the entire bottom base 42", the distance between the bottom base 42" and the curved outer surface 41' decreases. In essence, the finger that rests within this notch 42 and that is held resting elastically on the bottom base 42" emerges with its back from this notch to a greater or less extent as a function of the position that the portion 41 assumes. In essence, the greater the distance between the entry and exit portion and the closer the finger will be to the exit of the bottom base 42". Since the bottom base 42" has a dedicated profile, this implies that the back of the finger may emerge more or less from the notch based on the relative position assumed by the entry portion with respect to the exit portion. This therefore contributes to modifying the profile of the cradle, together of course with the positions assumed by the entry and exit portions.

More particularly, depending on the rotated and/or translated position of the portion 41 with respect to the entry one, to a greater or less extent the back of the finger emerges from the notch, making its profile prevail, which becomes part of the profile constituting the rolling surface of the core.

Assuming, for example, that a starting position is fixed for the entry portion (31, 32) and for the exit portion 41, as shown in FIG. 5, the more the exit portion 41 is lowered, therefore moved away, from the roller 10, and the more the finger tends to slide along the base 42" towards the direction opposite to the wall 42", i.e. towards the exit, resulting overall in a rolling surface profile as a function of the positions assumed by the parts, as explained above. A counter motion of the roller 20, i.e. of approach to the roller 10, results in an approach of the roller 20 to the roller 10 and therefore causes the counter motion of the fingers that move towards the wall 42' making their back prevail.

In this way the profile of the cradle (i.e. the sliding surface of the core) is modified as a function of the positions of the various parts.

Turning to FIG. 1A, it can thus be seen that the bar 41 is hinged to the lower roller via a side plate 47.

The bar is hinged idly with respect to the roller 20 in the sense that the roller rotates independently with respect to the bar 41 which remains fixed in a chosen and selectable position. The bar 41 therefore has a rotation axis that preferably coincides with the longitudinal axis of the roller 20 and thus with said bar rotatable around said longitudinal axis independently of the roller.

In essence, the roller 20 can rotate at its intended operating speed and the bar 41 can be fixed at a certain angle position with respect to said roller.

Its position rotated by a certain angle is selected and fixed by means of control arms 48 fixed at one end thereof to the cradle portion 41 and at the opposite end thereof fixed to an eccentric.

The eccentric is further fixed integrally to a further rotatable bar 49 controlled rotatingly by a motor 50.

By rotating the bar 49 the eccentric is brought into rotation, causing a motion of the arms 48, which thus control a rotation of the bar 41 around the longitudinal axis "A" of the roller 20, as schematised in FIGS. 1 and 1A.

The system is therefore similar to a connecting rod-crank with the arm 48 that translates causing the portion 41 to rotate.

Nothing would rule out a solution with a direct connection of an actuator to the portion (or rod, as the case may be) 41.

Furthermore, the frame described is integral with said roller 20 so that it assumes its relative position with respect to the upper roller.

Figure 9:
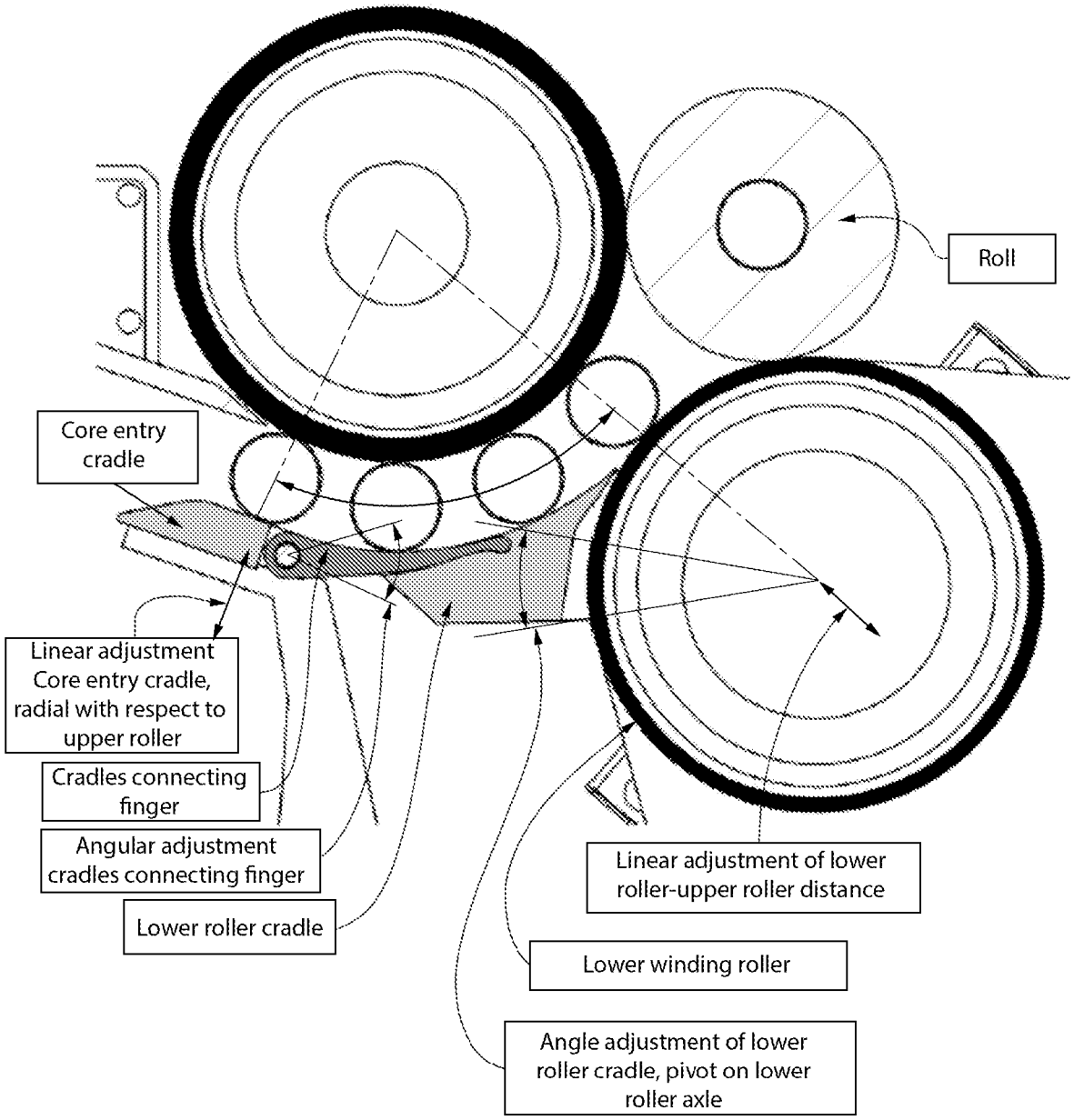
FIG. 9 is a schematisation showing the various possible kinematics.

Turning now to FIG. 9, this shows all the kinematics involved, in particular those relating precisely to the cradle system object of the invention.

Starting from the entry of the cradle (therefore upstream) and moving in the direction of advancement of the cores (therefore downstream) it can be noted that the front portion of the cradle fixed to the rest plane is translatable according to a motion of away from/closer to the upper roller in such a way as to modify the width of the passage channel for the cores, a channel delimited above by the upper winding roller and below precisely by the outer surface or profile of the cradle as a whole.

The image of FIG. 9 then shows the intermediate part (i.e. the finger) that is always kept in contact against and near the exit portion. Each finger has a possibility to rotate around its hinging and FIG. 9 therefore shows this angular rotation travel.

Similarly, FIG. 9 shows the rotation of the exit portion with respect to the lower roller, in addition to its possible translation integrally with the lower roller.

As mentioned, in fact, the well-known motion of translation to move the upper winding roller away from/closer to the lower one can be added to this kinematics.

In use, therefore, depending on the core diameter to be processed, a predetermined position of the front part of the cradle and of the rear part is selected exactly as indicated in FIG. 9.

This adjustment of the front and rear part can be independent of each other allowing a precise adjustment of the interference acting on the core both at the entry and at the exit independently of each other. In particular, therefore, thanks to this solution it would be possible, just to give an example, to have an entry that forms a channel of 36 mm in height for a core that for example is 40 mm in diameter, in order to create the right interference, and to adjust a height of the exit channel exactly to the measure of 40 mm.

As the diameter changes, the system performs a translation of the entry portion and a rotation (with possible translation) of the exit portion with a consequent adjustment rotation of the intermediate portion.

In theory, depending on the case, the same angle of the exit portion can be maintained for certain cores by changing only the position thereof.

In any case, the exit portion system is mounted to be rotatable, as well.

This not only varies the length of the passage duct but also the overall profile. In fact, depending on the position, e.g. rotation and/or translation, which the exit portion assumes and depending on the position of the entry portion, the finger will slide along the notch finding its final position and finding itself within the respective notch with its end which may be at any point of the base of the notch depending on the positions assumed.

The back of the finger can emerge from the notch by a certain amount as a function of the position assumed, thanks to the dedicated profile of the bottom base 42".

In this way, the cradle flexibly changes length and profile.

Basically, in an extreme case given here only by way of example, with reference to FIG. 2A, if, for example, the entry portion were all lowered and therefore moved away as far as possible from the upper roller while instead the exit portion were all rotated clockwise towards the upper roller, it is clear that in this configuration the finger would tend to be moved away from the exit portion and therefore with the end of the finger placed near the exit of the notch 42.

In this case the rolling surface has a certain profile and/or a certain length.

By varying the rotations and positions assumed between the front and rear part, the distance of the fingertip with respect to the wall 42' is actually changed, as the fingertip (which is always held in adhesion to the base 42" thanks to the twisting force) can move away from or closer to the wall 42".

The distance between the base 42" and the outer surface 41' since it is not constant, precisely by virtue of the concavity of the surface 41', implies that the back of the finger may be entirely contained in the notch for the part of the finger that fits into the notch or it may emerge therefrom for at least a part of the length of the finger that fits into the notch.

This implies, therefore, that as a result of the positions assumed by the entry and exit portions, the overall profile of the cradle changes, in addition to its overall length being changed.

In fact, the more the finger is extracted from the notch, the greater the length of the cradle, and the more the finger is entirely or almost entirely fitted into the notch, the smaller the distance between the front and rear portion of the cradle and thus the shorter the overall length of the path of the cradle.

This described solution, therefore, makes it possible in an extremely effective and functional manner to modify not only the width of the core insertion channel, but also allows to modify length and profile thereof.

Ultimately, as is clear from the description given and as can be seen, for example, from FIG. 5 or 9, in accordance with the invention a change in the length of the cradle and/or in the profile relative to the rolling surface of the cradle can be obtained.

The length of the cradle, i.e. the length of the rolling surface (thus the distance between an entry point and an exit point), can be modified since the possible translations of the entry portion (32) of the cradle and of the exit portion 41 are not parallel between them but incident at a point (see FIG. 5) so that, in case a translation of both said portions or of only one of them is hypothesised, there is a variation in the distance between the entry and exit portion of the cradle which consequently leads to a variation in the length of the rolling surface. The same applies also assuming the only rotation around the roller 20 of the exit portion in a possible combination with the translation of the entry portion 32. In the same way, said kinematics clearly causes a change in the overall profile of the rolling surface of the cradle as a function of the positions assumed by the entry and exit portion, said entry and exit portions being in variable positions depending on the needs and with the intermediate portion, which is connected to the entry portion and constrained in contact with the exit portion, creating a connection bridge between entry and exit.

The invention claimed is:

1. A cradle system for a rewinder machine, said cradle system forming a rolling surface for a core, said cradle system comprising:

at least two portions (32, 33, 41) arranged to define said rolling surface, wherein said at least two portions are each movable in a predetermined position so as to vary a profile of said rolling surface and/or a length of said rolling surface as a function of assumed positions of said at least two portions, and wherein said at least two portions comprise at least three portions comprising:

an entry portion (32) and an intermediate portion (33) rotatably connected to said entry portion (32), said entry portion (32) being movably mounted to have a plurality of different positions; and an exit portion (41) mounted at least rotatably with respect to a rotation axis (A), so as to be able to assume a plurality of different angular positions;

further comprising means that generate a force that keeps the intermediate portion in contact with the exit portion in such a way that said entry, intermediate and exit portions constitute said rolling surface for the core whose length and/or profile is/are a function of positions assumed by the entry portion and the exit portion.

2. The cradle system according to claim 1, wherein said entry portion (32) is fixed to a support (31) which can translate.

3. The cradle system according to claim 1, wherein said exit portion (41) can translate.

4. The cradle system according to claim 1, wherein said exit portion is configured to be rotatably mountable around a longitudinal axis of a lower winding roller (20) of the rewinder machine and mounted so as to be able to translate integrally with said lower winding roller.

5. The cradle system according to claim 1, wherein the entry portion is mounted to be translatable so as to be able to move away from or approach an upper winding roller (10) of the rewinder machine.

6. The cradle system according to claim 1, wherein said means that generate a force that keeps the intermediate portion in contact with the exit portion are elastic means.

7. A rewinder machine comprising:

an upper winding roller (10);

a lower winding roller (20); and a cradle system (32, 33, 41) which together with the upper winding roller forms a channel for inserting a core in a winding area of said rewinder machine, said channel being delimited above by said upper winding roller (10) and below by a rolling surface shaped by the cradle system;

said cradle system comprising a plurality of portions (32, 33, 41) arranged to define said rolling surface, wherein each one of said plurality of portions is movable in a predetermined position so as to vary a profile of said rolling surface and/or a length of said rolling surface as a function of assumed positions of said plurality of portions wherein said plurality of portions comprises three portions comprising:

an entry portion (32) and an intermediate portion (33) rotatably connected to said entry portion (32), said entry portion (32) being movable to have a plurality of different positions;

an exit portion (41) mounted at least rotatably with respect to a rotation axis (A), so as to be able to assume a plurality of different angular positions; and means for generating a force that keeps the intermediate portion in contact with the exit portion in such a way that said entry, intermediate and exit portions constitute said rolling surface for the core whose length and/or profile are a function of positions assumed by the entry portion and the exit portion.

8. The rewinder machine according to claim 7, wherein said exit portion is rotatably mounted around a longitudinal axis of said lower winding roller (20) and is further mounted so as to be able to translate integrally with said lower winding roller.

9. A method for making a winding cradle for a rewinder machine, the method comprising:

making the winding cradle by providing at least three distinct portions comprising:

an entry portion (32) and an intermediate portion (33) rotatably connected to said entry portion (32), said entry portion (32) being movable to have a plurality of different positions;

an exit portion (41) mounted at least rotatably with respect to a lower winding roller of said rewinder machine so as to be able to assume a plurality of different angular positions; and means that generate a force that keeps the intermediate portion in contact with the exit portion in such a way that said entry, intermediate and exit portions jointly constitute a rolling surface for a core whose length and/or profile are a function of positions assumed by the entry portion and by the exit portion.

* * * * *